US007107209B2

(12) United States Patent
Tabata et al.

(10) Patent No.: US 7,107,209 B2
(45) Date of Patent: Sep. 12, 2006

(54) SPEECH COMMUNICATION APPARATUS WITH GAIN CONTROL FOR CLEAR COMMUNICATION

(75) Inventors: Hajime Tabata, Saitama (JP); Yukio Miyamaru, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 667 days.

(21) Appl. No.: 09/986,723

(22) Filed: Nov. 9, 2001

(65) Prior Publication Data

US 2002/0059064 A1 May 16, 2002

(30) Foreign Application Priority Data

Nov. 10, 2000 (JP) ..... 2000-343519

(51) Int. Cl.
*G10L 19/14* (2006.01)

(52) U.S. Cl. ..... 704/225; 704/227; 704/270; 381/94.1; 381/104; 381/56; 381/94.7

(58) Field of Classification Search ..... 704/225–228, 704/231–257, 270; 381/94.1, 94.7, 104, 381/317, 56
See application file for complete search history.

(56) References Cited

U.S. PATENT DOCUMENTS 3,821,472 A * 6/1974 Herscher et al. ..... 704/233
4,718,099 A * 1/1988 Hotvet ..... 381/317
5,365,219 A * 11/1994 Wong et al. ..... 381/56
5,369,711 A * 11/1994 Williamson, III ..... 381/104
5,526,419 A * 6/1996 Allen et al. ..... 381/94.7
5,751,822 A * 5/1998 Yamaguchi et al. ..... 381/94.1
6,272,466 B1 * 8/2001 Harada et al. ..... 704/270
2003/0083874 A1 * 5/2003 Crane et al. ..... 704/246

FOREIGN PATENT DOCUMENTS

JP A5-183363 7/1993
JP 09-097095 * 4/1997
JP 003-038460 * 8/2001

* cited by examiner

*Primary Examiner*—Vijay Chawan
(74) *Attorney, Agent, or Firm*—Birch, Stewart, Kolasch & Birch, LLP

(57) ABSTRACT

A speech communication apparatus which is used with a microphone being fixed to a predetermined position in the vicinity of the mouth in such a manner as to prevent the transmission of uncomfortable noise such as sneezing, coughing or throat-clearing noise to a partner. There is provided a speech communication apparatus including a speech communication microphone, a speaker and a communication unit for amplifying an output signal from the speech communication microphone, the speech communication apparatus includes the communication unit having an amplifier for amplifying an input signal and outputting the input signal so amplified, and a controller for controlling the gain of the amplifier in response to an excessive input signal, wherein the controller controls the gain of the amplifier such that a reproduced sound of an excessive input signal is reduced to a predetermined level only for a predetermined period of time when the excessive input signal is detected.

27 Claims, 13 Drawing Sheets

SPEECH COMMUNICATION APPARATUS WITH GAIN CONTROL FOR CLEAR COMMUNICATION

CROSS-REFERENCE TO RELATED APPLICATIONS

The present application claims priority under 35 USC 119 to Japanese Patent Application No. 2000-343519 filed on Nov. 10, 2000 the entire contents thereof is hereby incorporated by reference.

BACKGROUND OF THE INVENTION

1. Field of the Invention

The present invention relates to a speech communication apparatus, and more particularly to a speech communication apparatus in which a speech communication microphone is mounted on a speech communicator in such a manner as to be fixed in the vicinity of the mouth of said speech communicator.

2. Description of Background Art

A communication system (an intercom) is known in which in order to establish speech communication between a rider and a driver of a riding type vehicle such as a motorcycle and a passenger of said riding type vehicle a speaker or a rider or driver of another vehicle, a speech communication microphone and an electric contact between them are mounted in a helmet for the driver, the passenger and the driver of another vehicle, respectively, and a communication unit mounted on the vehicle side is connected to the helmet for the driver, the passenger and the driver of another vehicle, respectively.

In the conventional communication system described above, since the speech communication microphone is normally fixed in the vicinity of the mouth of the driver when the helmet is worn by the driver, the speech communication microphone cannot be moved away from the vicinity of the mouth even when the driver feels like sneezing or coughing. This causes a problem that noise generated when the driver sneezes or coughs is allowed to be entirely detected by the speech communication microphone for transmission to the passenger or the driver of another vehicle who is in communication with the driver, thereby making his or her speech communication partner feel uncomfortable.

Although there exists no prior art developed to solve the technical problem described above, as a common technology for attenuating an excessive input which offends the ear JP-A-5-183363 discloses a technology in which a signal exceeding allowable positive or negative maximum values is converted into a code of a noise level at which noise cannot be substantially picked up by converting an input signal into a digital signal for data processing.

In the above prior art, the input signal is converted into the digital signal, the digital signal resulting from the conversion is data processed to determine whether or not the input signal is excessive, and if it is determined to be excessive the excessive input signal must be converted into a string of codes. Thus, there has been caused a problem that the construction of the prior art speech communication system becomes complicated.

SUMMARY OF THE INVENTION

An object of the present invention is to provide a speech communication apparatus which can solve the problem inherent in the prior art and in which a speech communication microphone is mounted in such a manner as to be fixed at a predetermined position in the vicinity of the mouth for use, the speech communication apparatus being constructed such that uncomfortable noises such as resulting from sneezing, coughing or clearing the throat are prevented from being transmitted to a speech communication partner.

With a view to attaining the object, according to the present invention, there is provided a speech communication apparatus including a speech communication microphone, a speaker and a communication unit for amplifying an output signal from the speech communication microphone, the speech communication microphone and the speaker being fixedly disposed in the vicinity of the mouth and the ear of a speech communicators, respectively, the speech communication apparatus being characterized in that the communication unit comprises an amplifying means for amplifying an input signal and outputting the input signal so amplified, and a control means for controlling the gain of the amplifying means in response to an excessive input signal, wherein the control means controls the gain of the amplifying means such that a reproduced sound of an excessive input signal is reduced substantially to a mute level only for a predetermined period of time when the excessive input signal is detected.

According to the present invention described above, a speech communication apparatus can be realized with a simple construction in which uncomfortable noises such as resulting from sneezing or coughing are prevented from being transmitted to a speech communication partner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
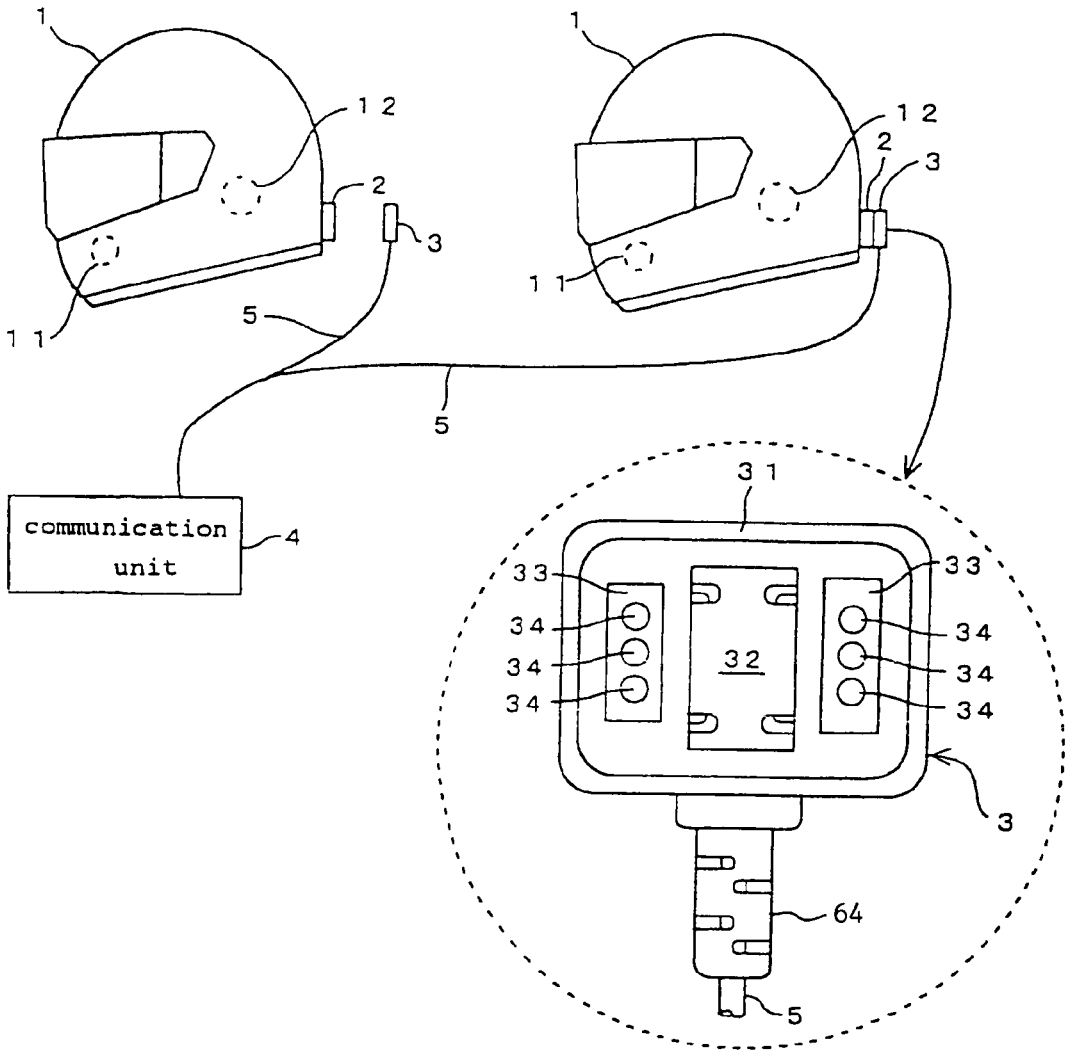
FIG. 1 is a diagram showing the construction of a vehicle communication system to which the present invention is applied.

The invention will be described in detail below with reference to the appended drawings. FIG. 1 is a diagram showing the construction of a vehicle communication system to which the invention is applied, and here an embodiment will be described in which communication occurs between two people riding the same vehicle, namely, a rider or driver and his or her passenger.

A microphone 11 and a speaker 12 are fitted in a helmet 1 that is to be worn by the driver and his or her passenger, respectively, and an external contact between the microphone 11 and the speaker 12 is exposed to the outside at a magnet side socket 2 which is one of sockets of a magnet connector. A magnetic material side socket 3 which is the other socket of the magnet connector is attached to a distal end of each cable 5 extending from a communication unit 4. The helmet 1 and the cable 5 are electrically and mechanically connected to each other by means of the magnet connector comprising the magnet side socket 2 and the magnetic material side socket 3 which constitute a pair.

As shown in an enlarged fashion within a circle indicated by a broken line in the same figure, formed on a connecting surface of the magnetic material side socket 3 is an annular rib 31 provided along the periphery thereof in such a manner as to erect therefrom, a magnetic material plate 32 fixedly attached to a bottom portion and a plurality of electrodes 34 exposed on an upper surface of a land-like portion 33 provided on the bottom portion in such a manner as to rise therefrom, and no source for generating lines of magnetic force is provided on the connecting surface. The cable 5 is drawn from the magnetic material side socket 3 via a shock absorbing bushing 64.

Figure 2:
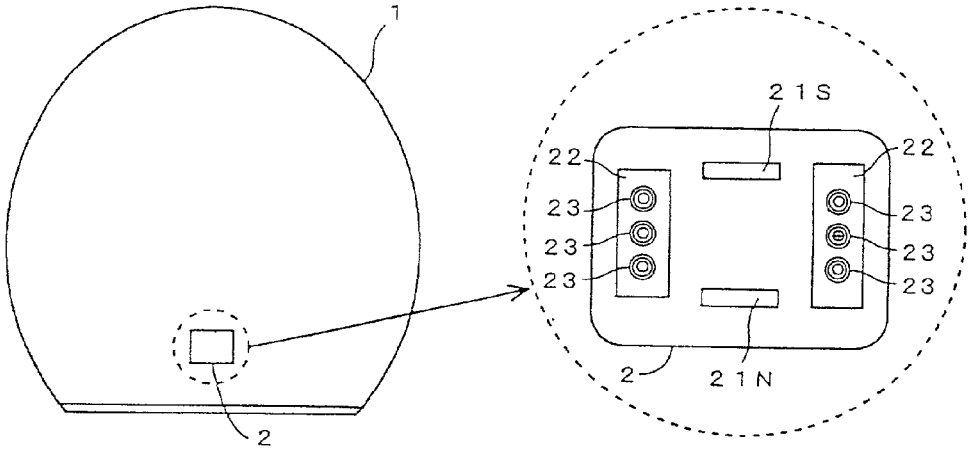
FIG. 2 is a rear view of a helmet.

FIG. 2 is a rear view of the helmet 1 with the magnetic material side socket 3 of the cable 5 not being attached to the helmet 1, and a connecting surface of the magnet side socket 2 of the magnet connector is exposed deep inside the socket 2. As is shown in an enlarged fashion within a circle indicated by a broken line on the right hand side in FIG. 2, formed on the connecting surface of the magnet side socket 2 are an S pole iron piece 21S, an N pole iron piece 21N and a plurality of electrodes 23 exposed at a bottom portion within a depression 22. When the magnet side socket 2 is connected to the magnetic material side socket 3 the respective electrodes 23, 34 are brought into contact with each other to thereby secure an electric connection therebetween.

The communication unit 4 is detachably fixed to a suitable location on the vehicle. Alternatively, the communication unit 4 is attached to the body of either of the riding individual or is accommodated in the individual's clothes. When the riding individual get off the vehicle and the communication unit is not in use, the cable can be removed from the helmet 1 and can be wrapped around the communication unit 4 for carrying.

As is described above, in this embodiment, of the pair of magnet connectors for connecting the helmet 1 with the cable 5 the magnet side socket 2 is fixed to the helmet 1 side, whereas the magnetic material side socket 3 having no source for generating lines of magnetic force is provided at the one end of the cable 5. Therefore, when removing the cable 5 from the helmet 1 and wrapping it around the communication unit 4 for carrying even if the cable so wrapped around the communication unit is put in an individual's pocket or bag together with a magnetic card or a magnetic disc, no magnetic information loaded on the card or disc is affected.

Figure 3:
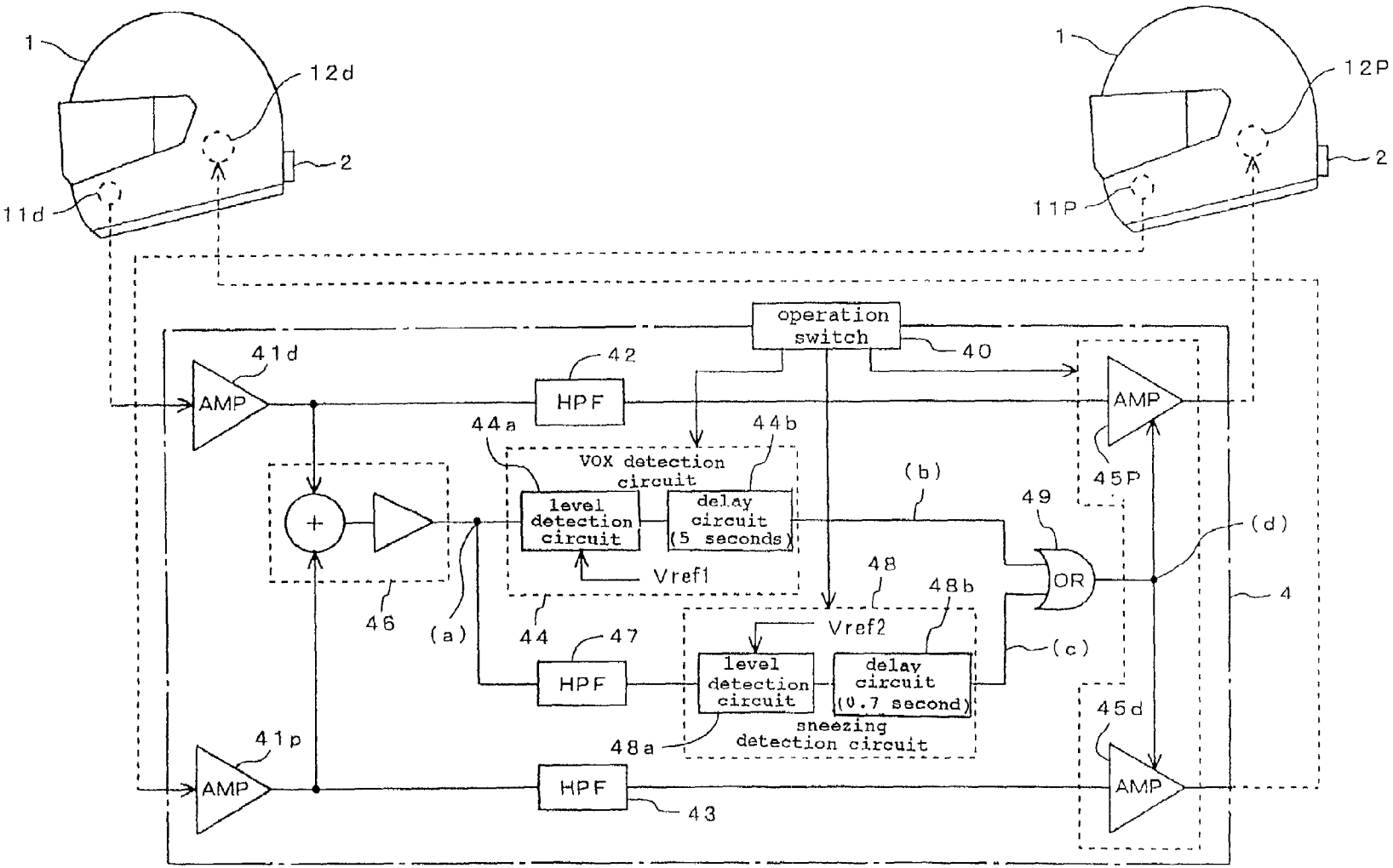
FIG. 3 is a block diagram of a communication unit.

FIG. 3 is a block diagram showing the construction of a main part of the communication unit 4, and like reference numerals to those described previously denote like or equivalent portions to those described above. The communication unit 4 according to the present invention is provided with a function to prevent the transmission of a relatively loud noise such as a sneeze or a cough to a speech communication partner.

Microphone amplifiers 41*d*, 41*p* amplify voice signals detected at microphones 11*d*, 11*p*, respectively, which are mounted in the helmets of the driver and the passenger and output the signals so amplified. Low frequency constituents of an output signal from the microphone amplifier 4 are removed or attenuated by a high pass filter (HPL) 42 and the output signal so treated is then inputted into a speaker amplifier 45*p*. Similarly, low frequency constituents of an output signal from the microphone amplifier 41*p* are removed or attenuated with a high pass filter 43 and the signal so treated is then inputted into a speaker amplifier 45*d*.

The respective speaker amplifiers 45*p*, 45*d* are provided with a muting terminal, and when a control signal of "H" level enters the muting terminal an output signal therefrom is attenuated or cut off.

An amplifier 46 (a mixer amplifier) provided with a mixer function synthesizes and amplifies output signals from the microphone amplifies 41*d*, 41*p* and outputs the output signals so synthesized and amplified to a VOX detection circuit 44 and then to a sneezing detection circuit 48 via an HPL 47.

The VOX detection circuit 44 includes a level detection circuit 44*a* and a delay circuit 44*b* (5 seconds in this embodiment), whereby a signal equal to or exceeding a reference value Vref1 is detected by the level detection circuit 44*a* the VOX detection circuit 44 produces an output signal at an "L" level and maintains the "L" level for 5 seconds even after no signal equal to or exceeding the reference value Verf1 is detected.

The reference value Vref1 is set to a value approximate to a minimum value of a voice signal that would be detected if speech communication takes place between the individuals riding the vehicle. Consequently, it can be determined that speech communication is taking place in case the output from the mixer amplifier 46 exceeds the reference value Vref1, whereas in the case where the output falls below the reference value Vref1 it is determined that the speech communication is not taking place.

The sneezing detection circuit 48 includes a level detection circuit 48*a* and a delay circuit 48*b* (in this embodiment, 0.7 second), whereby when a signal equal to or above a reference value Vref2 is detected by the level detection circuit 48*a* the sneezing detection circuit 48 produces an output signal at an "H" level only for 0.7 second. The period of time of 0.7 second is a time that is predicted to be a maximum value for a period of time during which a noise resulting from a sneeze or a cough continues. The reference value Vref2 is set to a value in the vicinity of a minimum value for a signal level at which an input signal resulting from a noise such as sneezing or coughing noise can be detected. Consequently, in case an output from the mixer amplifier 46 exceeds the reference value Vref2 it can be determined that an input signal inputted at this point in time is a signal attributed to a noise such as sneezing and coughing.

An OR circuit 49 outputs a theoretical sum of an output signal from the VOX detection circuit 44 and produces an output from the sneezing detection circuit 48 to the muting terminals of the respective speaker amplifiers 45*p*, 45*d* as a control signal. An operating switch 40 includes switches for varying the reference values Vref1 and Vref2, the delay times of the delay circuits 44*b*, 48*b* and the gains of the speaker amplifiers 45*p*, 45*d*.

Figure 4:
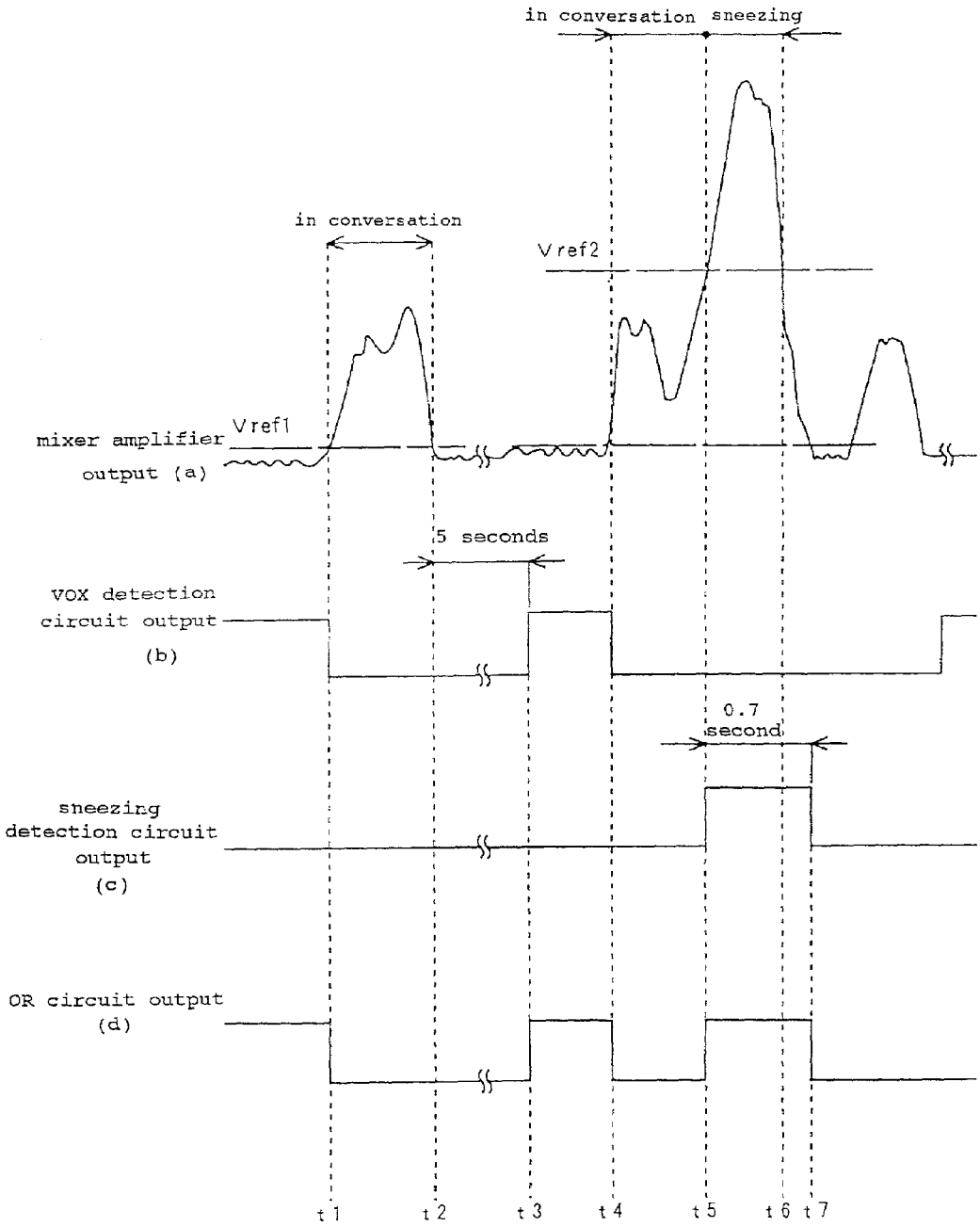
FIG. 4 is a diagram illustrating signal waveforms of a main part of the communication unit.

FIG. 4 is a diagram showing signal waveforms of the main part of the communication unit 4. Since a voice signal outputted from the mixer amplifier 46 stays below the reference value Vref1 until time t1, the output from the VOX detection circuit 46 is maintained at the "H" level. As a result, the output of the OR circuit 49 becomes the "H" level and the respective speaker amplifiers 45*p*, 45*d* become mute, whereby the power consumption of the speaker amplifiers 45*p*, 45*d* is largely suppressed.

Thereafter, when conversation takes place between the individuals riding the vehicle and the output of the mixer amplifier 46 increases and exceeds the reference value Vref1 at time t1 the output of the VOX detection circuit 44 turns to the "L" level. Since the output of the sneezing detection circuit 48 still stays at the "L" level as this occurs, the output of the OR circuit 49 becomes the "L" level. As a result, the muting facilities of the respective speaker amplifies 45*p*, 45*d* are cancelled, voice signals outputted from the respective HPF 42, 43 are amplified by the respective speaker amplifiers 45*p*, 45*d* and are outputted from the speakers 12*p*, 12*d*.

Thereafter, the conversation stops at time t2 and the output of the mixer amplifier 46 is reduced below the reference value Vref1, and this state continues for 5 seconds. Then, the output of the VOX detection circuit turns to the "H" level at time t3. As a result, the output of the OR circuit 49 becomes the "H" level, whereby the respect speaker amplifiers 45*p*, 45*d* reactivates the muting facilities thereof.

Thereafter, when conversation starts again and the output of the mixer amplifier 46 exceeds the reference value Vref1 at time t4 the output of the VOX detection circuit 44 turns to the "L" level. As this occurs, since the output of the sneezing detection circuit 48 still remains at the "L" level, the output of the OR circuit 49 becomes the "L" level. As a result, since the muting facilities of the respective speaker amplifiers 45*p*, 45*d* are cancelled, voice is outputted from the respective speakers 12*p*, 12*d*.

When either of the individuals riding the vehicle sneezes during the conversation and the output of the mixer amplifier 46 exceeds the reference value Vref2 at time t5 the output of the sneezing detection circuit 48 turns to the "H" level and the delay circuit 48*b* starts a 0.7 second timer. As a result, the output of the OR circuit becomes the "H" level only for 0.7 second and the muting facilities of the respective speaker amplifiers 45*p*, 45*d* are activated, whereby there is no case where the sneezing noise is reproduced by the speakers.

The noise such as sneezing or coughing is deadened within a short period of time, and the output of the mixer amplifier 46 decreases below the reference value Vref2 at time t6. Consequently, in this embodiment assuming that the noise is completely attenuated at time t7 at which the 0.7-second timer of the delay circuit 48*b* times out, the output of the sneezing detection circuit 48 is returned to the "L" level. On the other hand, in case where there is no disruption to the conversation for 5 or more seconds from time t4 to time t7, since the output of the VOX detection circuit 44 is maintained, the output of the OR circuit becomes again the "L" level, whereby speech communication becomes possible.

According to the embodiment, since sneezing or coughing is determined by the signal level thereof and the muting facility of the mixer amplifier is activated for the predetermined period of time (0.7 second in this embodiment) when sneezing or coughing is detected, the physiological noise such as sneezing or coughing noise can be prevented from being reproduced from the speaker of the speech communication partner with an extremely simple construction.

Note that while the muting period by the sneezing detection circuit 48 is set at 0.7 second in this embodiment, in case the apparatus is made to deal with continuous sneezing, it is desirable to set the muting period at on the order of 5 seconds. The result of observations by the inventors shows that since sneezing tends to stop within 5 seconds, it is desirable that the muting period is set to a range from 0.7 to 5 seconds both included.

In addition, although the volume and continuity time of sneezing or coughing vary from person to person, in this embodiment, the operating switch 40 is provided so as to vary the reference value Vref2 and the set time of the delay circuit 48*b*. Consequently, in case the reference value Vref2 and the delay time are adjusted depending upon the physical characteristics of individuals, a problem can be solved wherein speech communication is disrupted due to the muting period being prolonged more than needed, or, on the contrary, a problem that a noise cannot be cut off sufficiently due to the muting period being too short.

Furthermore, in the aforesaid embodiment, while the sneezing detection circuit 48 is described as comparing the input signal with the reference value Vref2 so as to determine that a signal exceeding the reference value Vref2 is a signal responding to sneezing or coughing, the invention is not limited thereto but the sneezing detection circuit 48 may be constituted by a differential circuit so as to detect the varying factor of the input signal, so that a drastic input signal such as a signal wherein the varying factor of which rises and exceeds a predetermined reference varying factor is determined as an input signal responding to sneezing or coughing.

Incidentally, in the above embodiment, while the communication unit 4 is described as being easily attached to or detached from the vehicle body, the communication unit 4 may be constructed as a fixed type of communication unit which is fixed to the vehicle. However, in a case where the communication unit 4 is fixed to the vehicle, in order to improve the operability thereof, it is desirable that the communication unit is fixed in the vicinity of the handgrips of the handlebar. However, since the displacement amount becomes large at a location in the vicinity of the handgrips when the handlebar is operated to steer the vehicle, there may be a risk that the connecting cable 5 interferes with the operation of the communication unit when the handlebar is operated to steer the vehicle. Consequently, in the case when a vehicle fixed type communication unit 4 is used, as shown in FIGS. 5 and 6, it is desirable that the communication unit 4 is divided into an operating portion 4*a* which includes the operating switch 40 and a relay portion 4*b* linked together by wire 4*c* (FIGS. 5, 6), the two portions that are so divided are then connected to each other with a relay cable, and as shown in FIGS. 7(*a*), 7(*b*), the operating portion 4*a* is disposed in the vicinity of the handgrip, whereas the relay portion 4*b* is fixed to a central portion or the like of the handlebar where the displace amount is small when the handlebar is operated to steer the vehicle.

Figure 5:
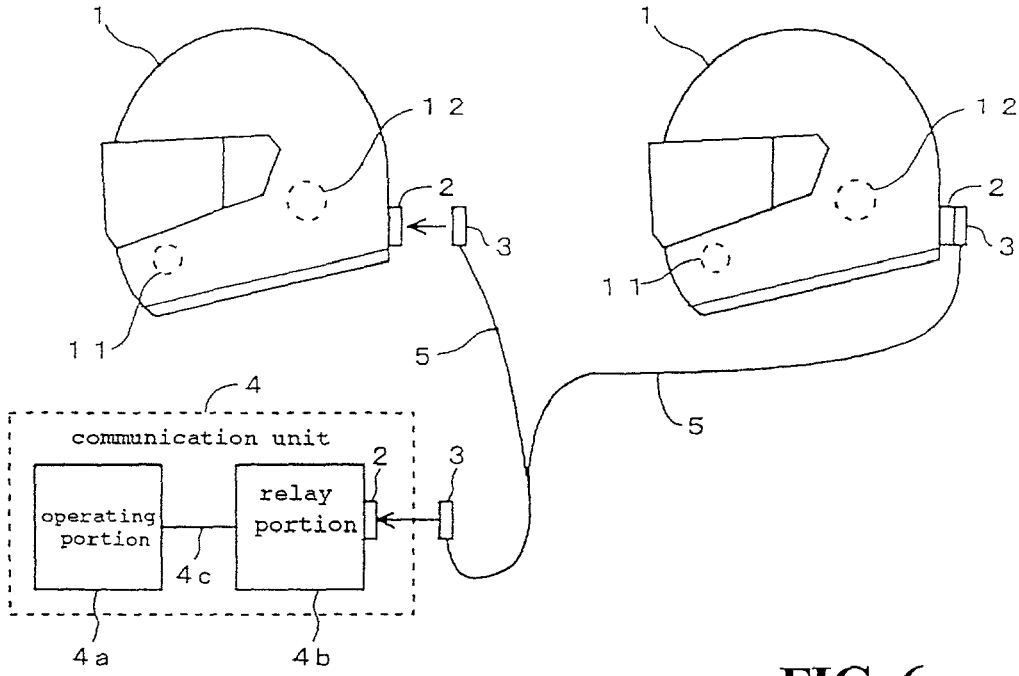
FIG. 5 is a diagram showing the construction of another vehicle communication system to which the invention is applied.
Figure 6:
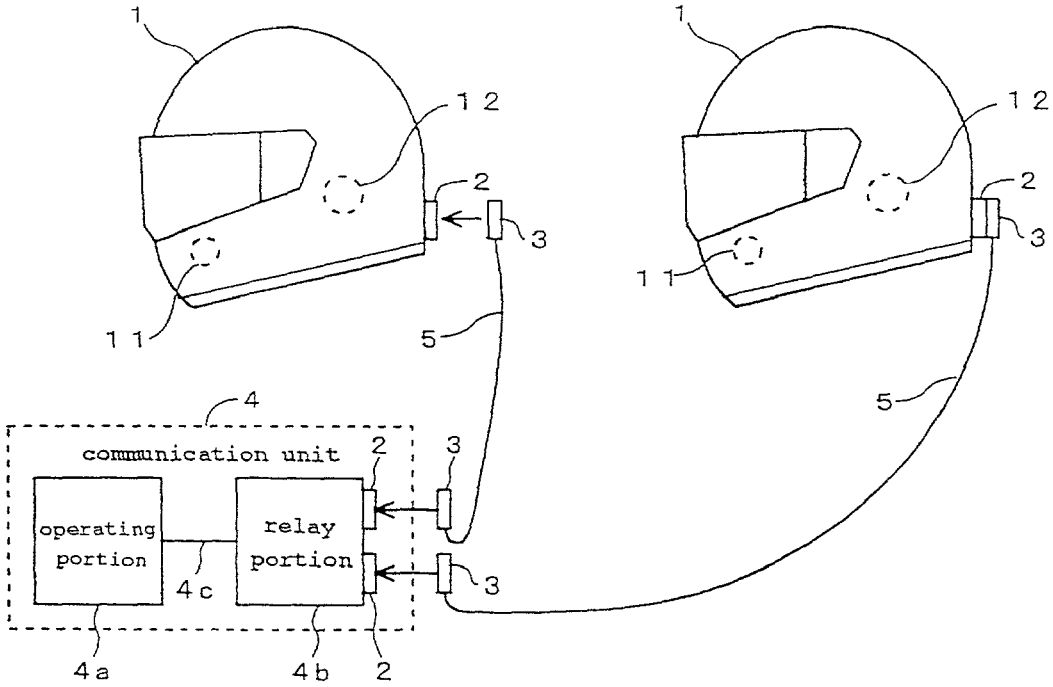
FIG. 6 is a diagram showing the construction of a further vehicle communication system.
Figure 7A:
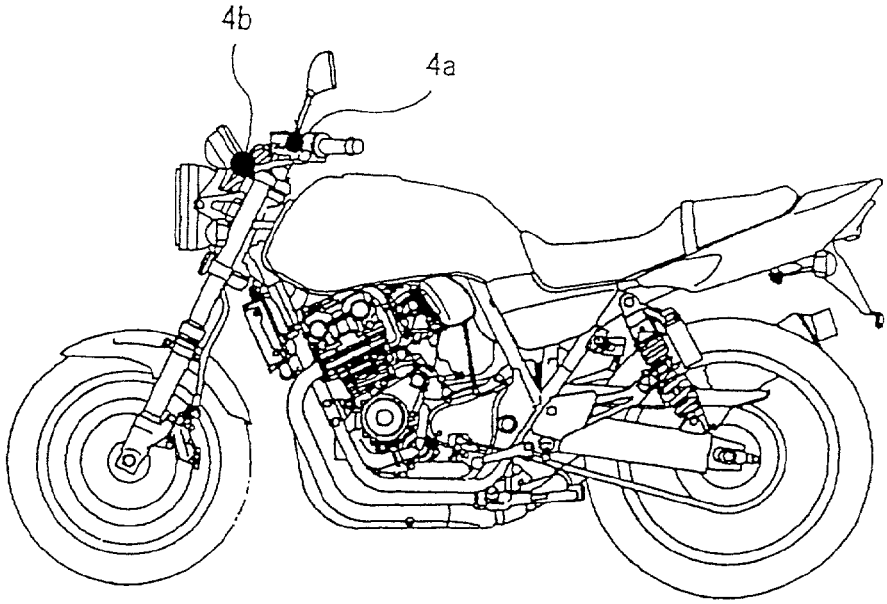
FIGS. 7(*a*) and 7(*b*) are diagrams showing a method for disposing the communication unit on a vehicle.
Figure 7B:
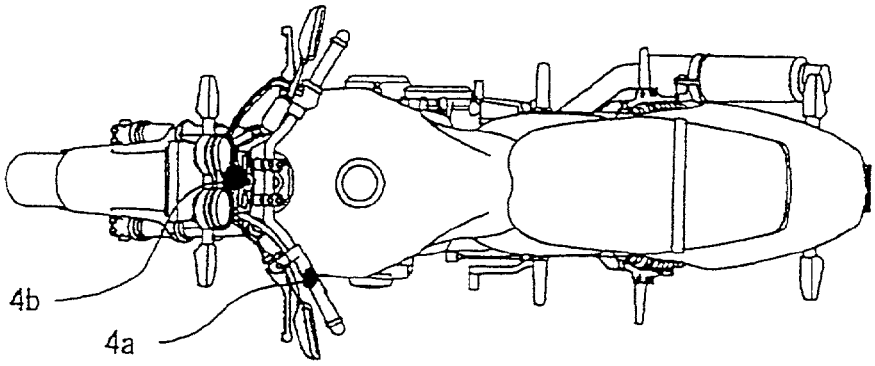
Figure 8:
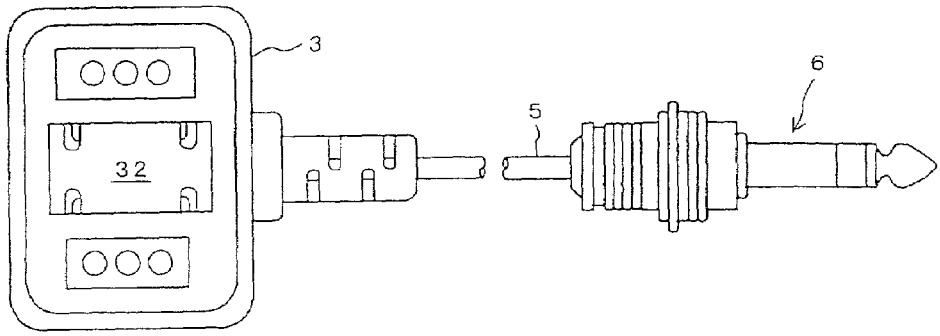
FIG. 8 is a diagram showing a first embodiment of a connecting cable for connecting the communication unit with the helmet.

Furthermore, in case the communication unit 4 is constructed as a fixed type, as shown in FIGS. 5 and 6, the cable 5 also needs to be constructed detachably from the communication unit 4. In this case, too, as shown in FIG. 8, in consideration of a possibility that the cable 5 is put in an individual's pocket or bag, the magnetic material side socket 3 is provided on the helmet side end of the cable 5, whereas a plug 6 is provided on the communication unit 4 side end thereof, whereby the socket and the plug are connected to each other when the plug 6 is inserted into a jack (not shown) provided on the communication unit 4.

However, since individuals riding a motorcycle tend to wear gloves during many occasions, it is desirable that the connection of the communication unit 4 and the cable 5 should be constructed so as to be connected while the individuals are wearing the gloves. However, with the connection by the plug 6 and the jack, since the plug 6 needs to be inserted into a small hole in the jack, the connection is difficult to be implemented while wearing gloves.

Furthermore, with the connection of the plug 6 and the jack, when a load is applied between the communication unit 4 and the cable 5 so that the unit and the cable are disconnected from each other, in the case where the load application direction is deviated from the plug insertion direction, a large magnitude of load is inevitably applied to the plug 6 and the jack when the unit and the cable are disconnected from each other.

Figure 9:
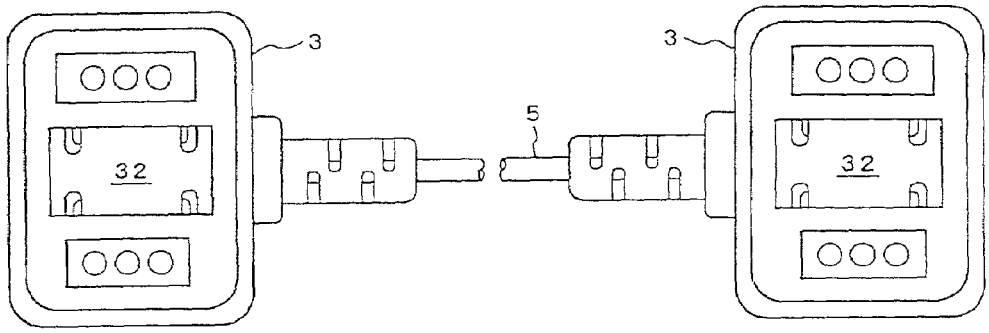
FIG. 9 is a diagram showing a second embodiment of a connecting cable for connecting the communication unit with the helmet.

In order to solve a problem like this, as shown in FIG. 9, a magnetic material side socket 3 is provided on the communication unit 4 side end of the cable 5, similarly to the helmet side, so that the magnetic material side socket 3 may be connected to the magnet side socket 2 provided on the communication unit 4. Even with this construction, since there exists no magnet side socket 2 which constitutes a source for generating lines of magnetic force on the cable 5, even if the cable 5 is put in an individual's pocket or bag together with a magnetic card, there is no risk that the things accommodated in the pocket or bag such as a magnetic card are magnetically affected.

Figure 10:
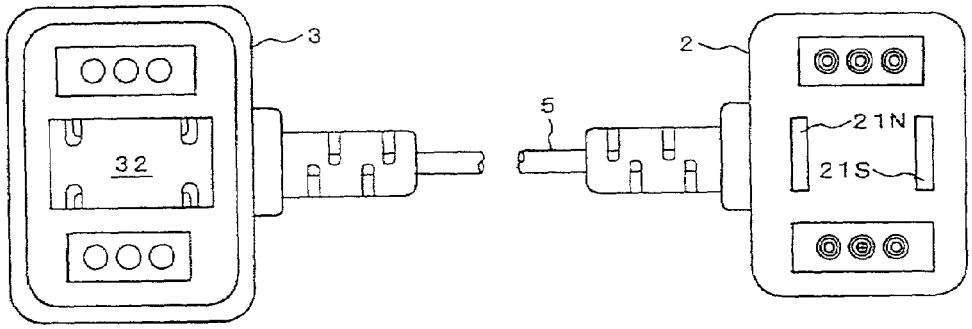
FIG. 10 is a diagram showing a third embodiment of a connecting cable for connecting the communication unit with the helmet.

Moreover, in a case where a construction as shown in FIG. 6 is adopted in which the respective helmets 1 are connected to the communication unit 4 independently with the cables 5, as shown in FIG. 10, the magnet side socket 2 and the magnetic material side socket 3 may be provided at the respective ends of the cables 5 so that the magnet side sockets 2 are connected to the magnetic material side sockets 3 provided on the communication unit 4 side.

Figure 11:
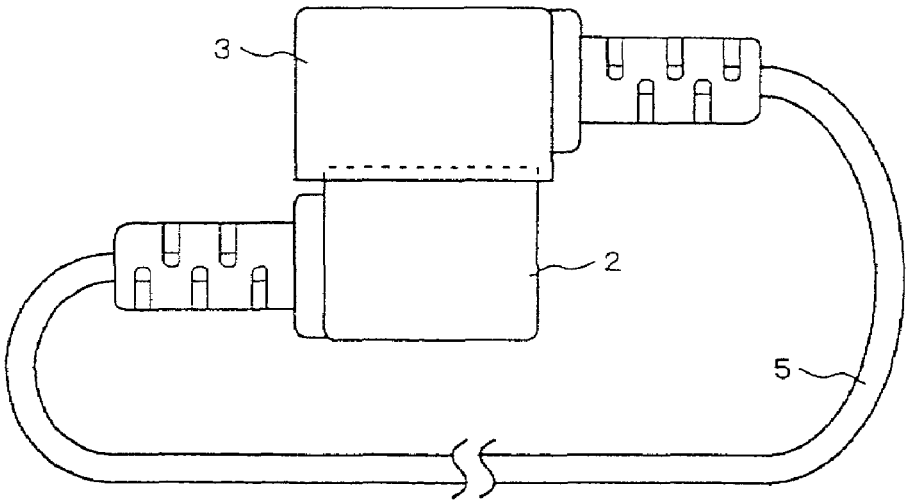
FIG. 11 is a diagram showing a method for carried the connecting cable shown in FIG. 9.

According to this construction, when the cables 5 are carried, as shown in FIG. 11, in case the magnet side socket 2 and the magnetic material side socket 3 which are provided at the respective ends of the cable 5 are connected together, magnetic force generated from the magnet side socket 2 forms a closed magnetic circuit within the magnet connector. Thus, since lines of magnetic force are not exposed to the outside, even if the cable 5 is accommodated together with a magnetic card, the magnetic effect on the magnetic card by the cable 5 can be reduced.

Figure 12:
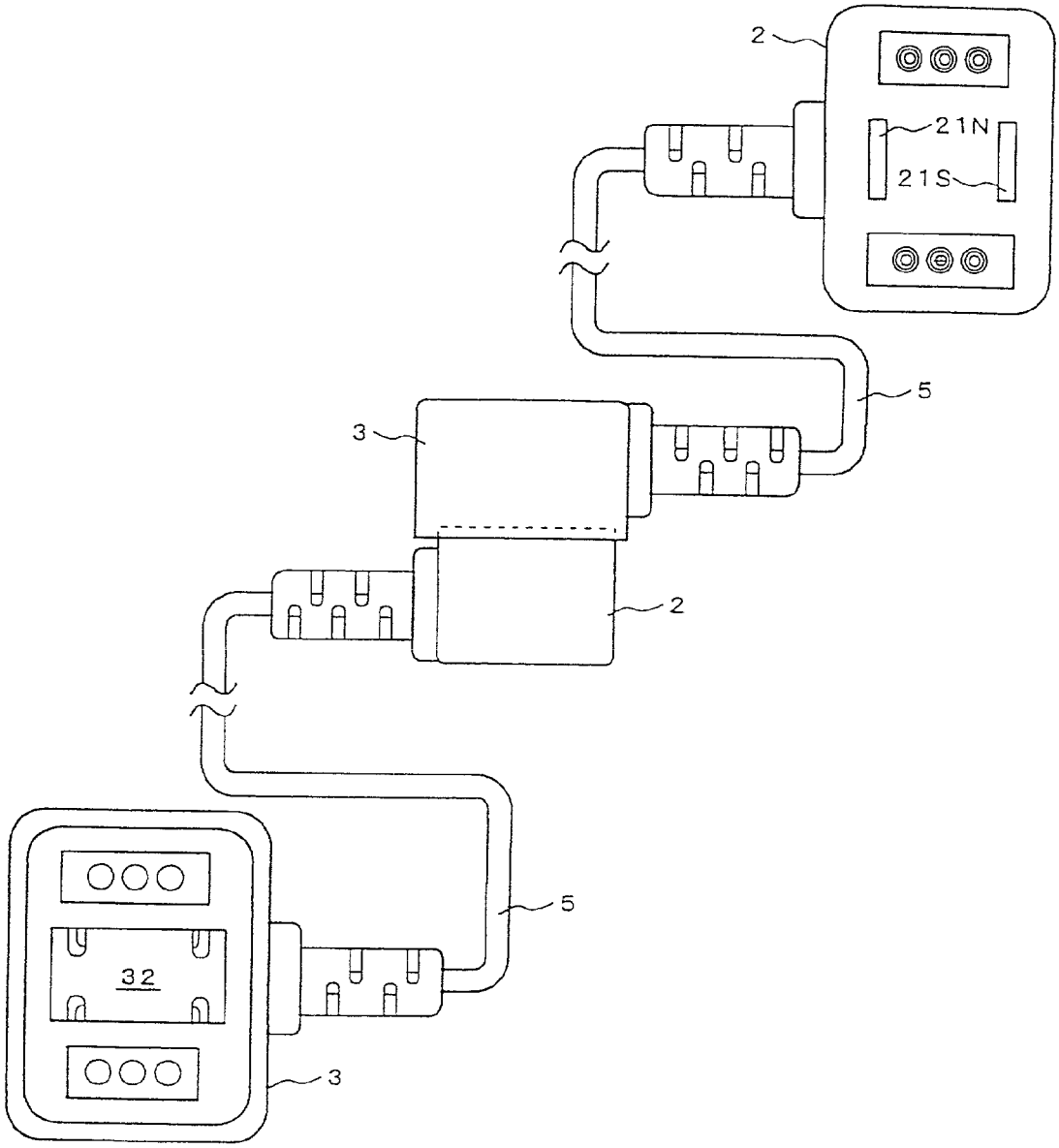
FIG. 12 is a diagram showing a method for extending the connecting cable shown in FIG. 9.

Furthermore, as has been described above, since the magnet side socket 2 and the magnetic material side socket 3 are provided at the respective ends of the cable 5, respectively, as shown in FIG. 12, a plurality of cables 5 can be connected in a series fashion, whereby the cables can be extended.

Figure 13:
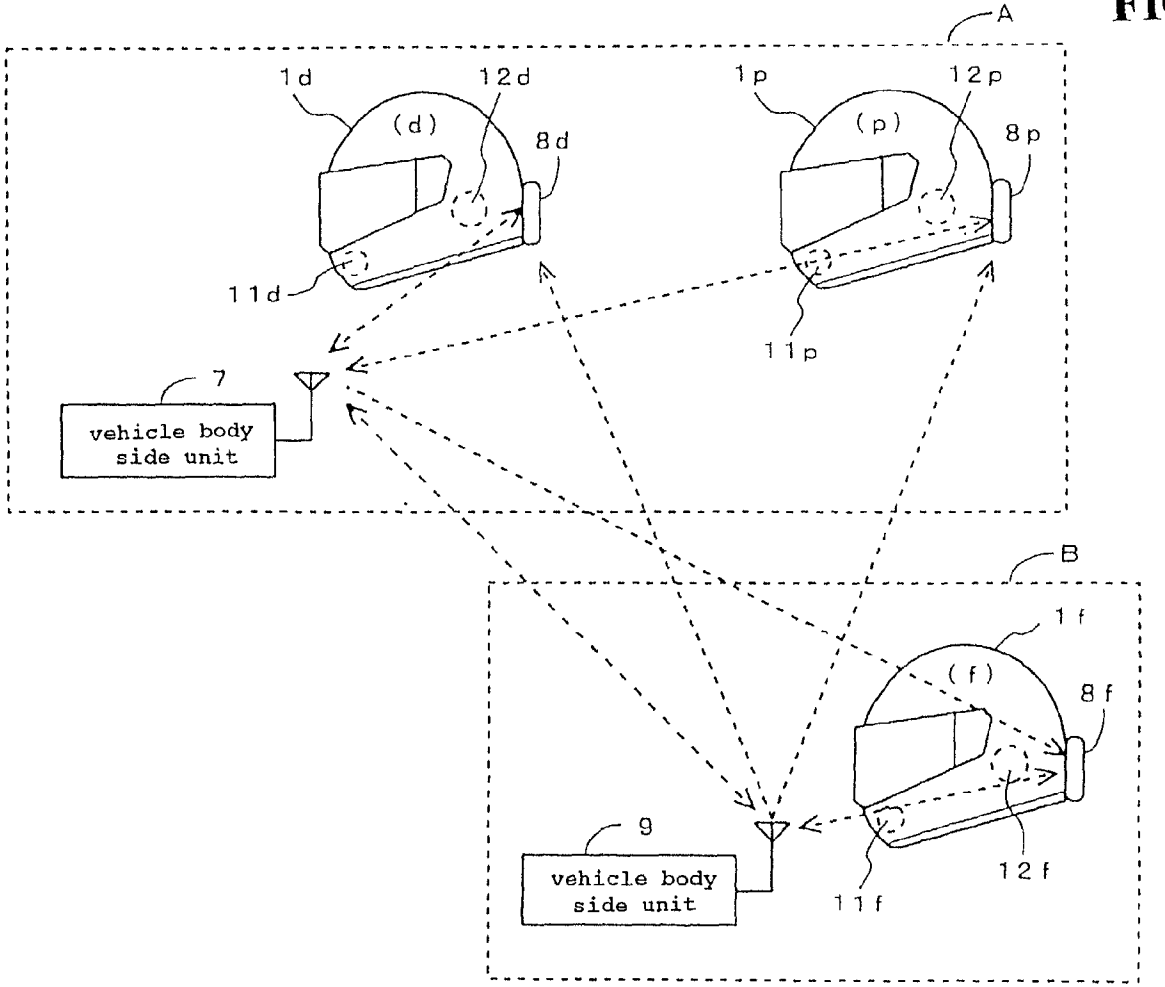
FIG. 13 is a typical view illustrating a communication method by a vehicle radio communication system to which the invention is applied.

Next, an example will be described in which the invention is applied to a vehicle radio communication system. FIG. 13 is a typical view illustrating a communication mode in a vehicle radio communication system to which the invention is applied, in which like reference numerals to those previously described denote like or equivalent portions to those previously described. Here, an example will be described in which communication is made among three individuals riding on two separate vehicles A, B.

A microphone 11, a speaker 2 and a radio wave type radio communication unit 8 are mounted in a helmet 1 worn by each of the individuals riding the vehicle. The radio communication unit 8 is attached to a central portion on the rear of the helmet 1 via a detachable fixing member. Provided, respectively, on the vehicles A, B are vehicle body side units 7, 9 for use in radio communication with the respective radio communication units 8.

In the construction described above, in a case where the individuals riding on the vehicle A, that is, the driver (d) and the passenger (p) try to communicate with each other, for example, the voice of the driver is detected by the microphone 11*d* and is then converted into a voice signal for transfer to the radio communication unit 8*d*. The radio communication unit 8*d* of the driver communicates directly or indirectly via the vehicle body side unit 7 on his or her own vehicle with a radio wave type radio communication unit 8*p* of the passenger.

In a case where the individuals riding on the vehicle A communicate with the individual riding (f) on the vehicle B, for example, radio wave sent out from the radio communication unit of the driver on the vehicle A is received by the vehicle side unit 7 on his or her own vehicle, where the radio wave is amplified and re-sent out. The radio wave sent out from the vehicle body side unit 7 is received by the radio wave type radio transmitter-receiver unit 8*p* of the passenger, as well as by the radio communication unit 8*f* of the driver of the vehicle B, and the radio wave so received is then reproduced from the speaker 12*f*.

The radio wave sent out from the radio communication unit 8*f* of the driver of the vehicle B is received by the vehicle side unit 9 on his or her own vehicle, where the radio wave so received is amplified and re-sent out. The radio wave sent out from the vehicle side unit 9 is received at the respective radio communication units 8*d*, 8*p* of the driver and the passenger on the vehicle A and is then reproduced from the speakers 12*d*, 12*p*.

Note that in addition to the communication mode described above, all the communications made between the vehicles A, B may be implemented via the vehicle side units 7, 9, and in this case, the voice of the driver of the vehicle B is transmitted to the driver (the radio communication unit 8*d*) and the passenger (the radio communication unit 8*p*) on the vehicle A by way of the radio communication unit 8, the vehicle side unit 9 and the same unit 7.

Figure 14:
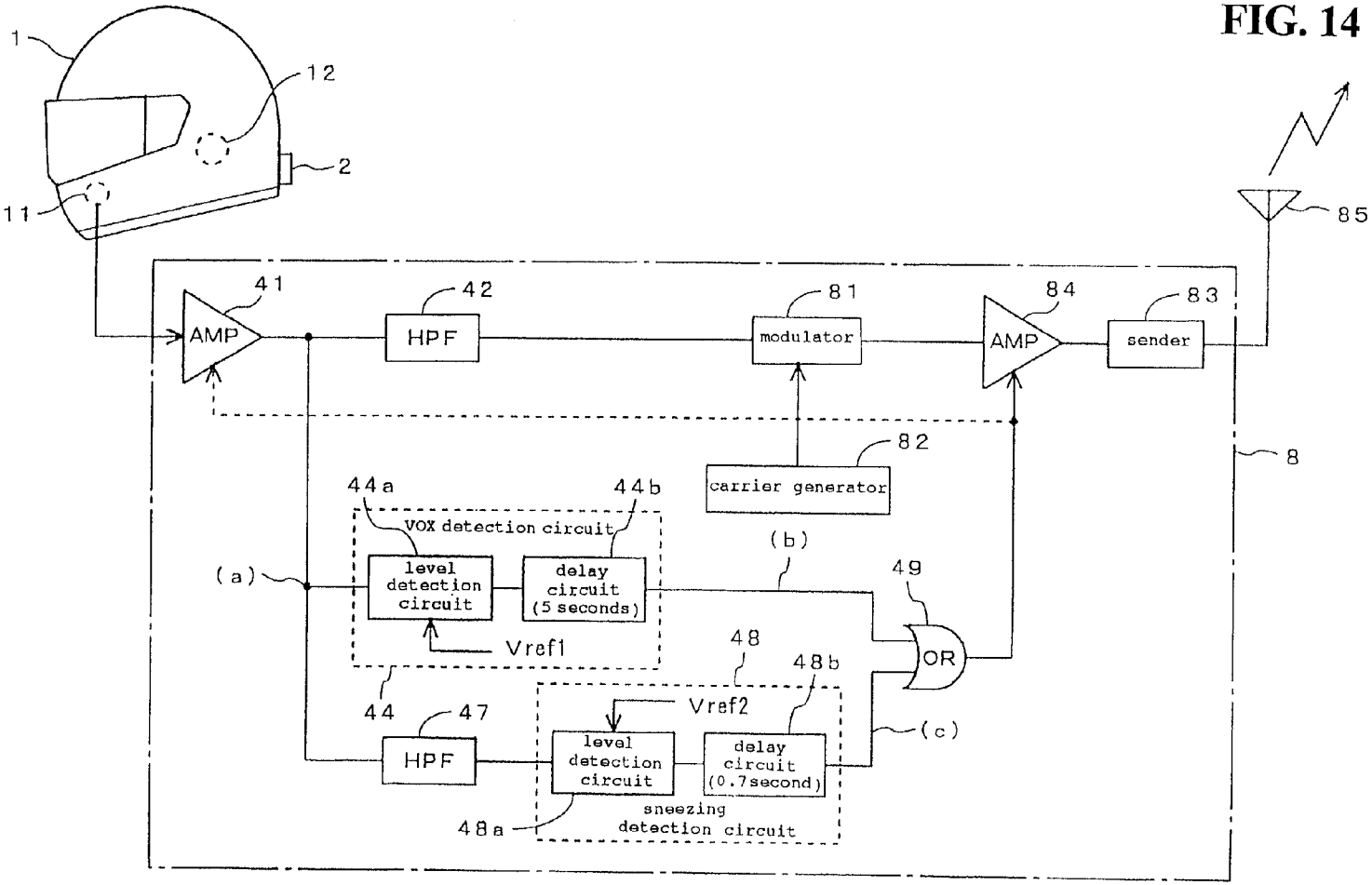
FIG. 14 is a block diagram of the radio communication system.

FIG. 14 is a block diagram illustrating the construction of a main part of the radio communication unit 8, and like reference numerals to those described previously denote like or equivalent portions to those described previously. The communication units 8 used in this embodiment are also provided with a function to prevent the transmission of relatively loud noise such as sneezing or coughing noise to the speech communication partners.

A microphone amplifier 41 amplifies a voice signal detected by the microphone 11 mounted in the helmet 1 and outputs the voice signal so amplified. Low frequency constituents of an output signal from the microphone amplifier 41 are removed or attenuated by a high pass filer (HPL) 42, and thereafter the output signal so processed then enters a modulator 81. The modulator 81 modulates a carrier signal outputted from a carrier generator 82 with the output signal from the HPL 42 and then outputs the modulated signal to a power amplifier 84. The modulated signal which has been amplified at the power amplifier 84 is propagated to from an antenna 85 via a sender 83. The power amplifier 84 is provided with a muting terminal and when a control signal of an "H" level is inputted in the muting terminal, an output signal from the power amplifier 84 is attenuated or cut off.

A VOX detection circuit 44 produces an output signal at an "L" level, as similarly to the previous example, when a signal equal to or above a reference value Vref1 is detected by a level detection circuit 44*a*, and even after a signal equal to or above the reference value Vref1 is detected any more the VOX detection circuit maintains the "L" level for 5 seconds.

A sneezing detection circuit 48 produces, as similarly to the previous example, an output signal at an "H" level only for 0.7 second when a signal equal to or above a reference value Vref2 is detected by a level detection circuit 48*a*. An OR circuit 49 outputs a theoretical sum of the output signal from the VOX detection circuit 44 and the output signal from the sneezing detection circuit 48 to the muting terminal of the power amplifier 84 as a control signal.

In this embodiment, the reproduction of a noise such as a sneezing or a coughing noise from the speaker can be prevented in addition to providing an extremely simple construction.

Note that while the above embodiment is described such that the gain of the power amplifier 84 is controlled with the output signal of the OR circuit 49, the gain of the microphone amplifier 41 of the input stage is restricted so that only the carrier signal is sent out from the modulator 81. Alternatively, it may be constructed such that the supply of the carrier signal from the carrier generator 82 to the modulator 81 is restricted.

Figure 15:
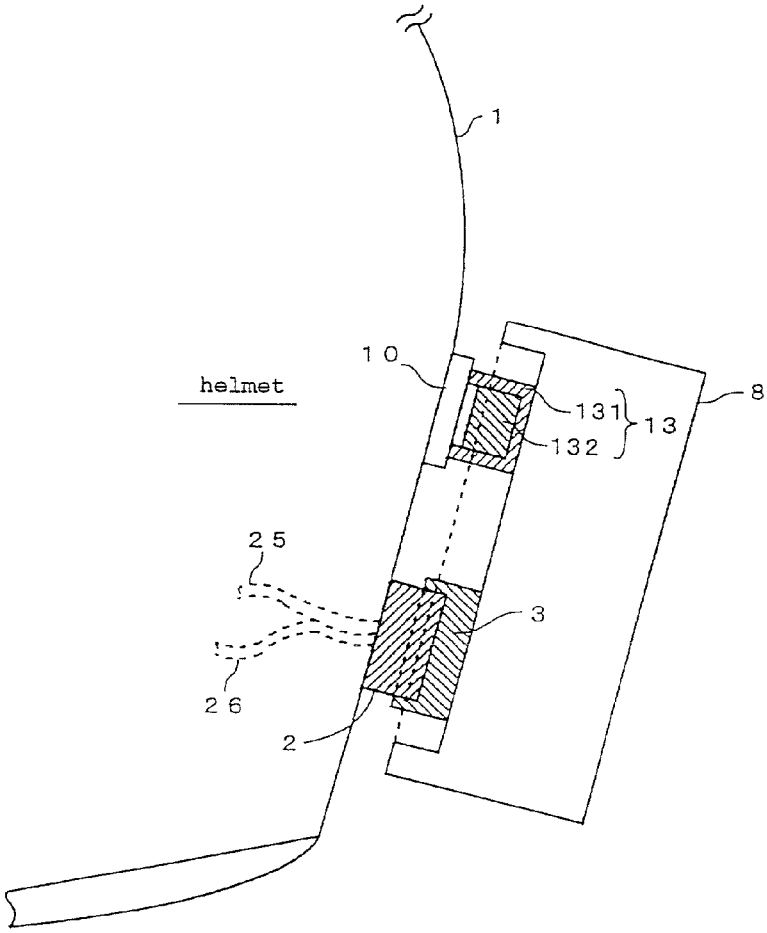
FIG. 15 is a side view showing a first method for attaching the ratio communication unit to the helmet.
Figure 16:
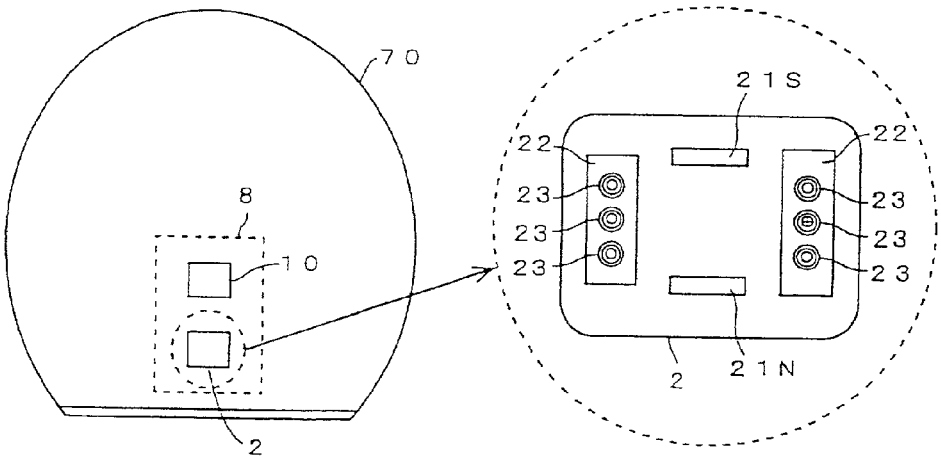
FIG. 16 is a rear view of the helmet with the radio communication unit not attached thereto.
Figure 17:
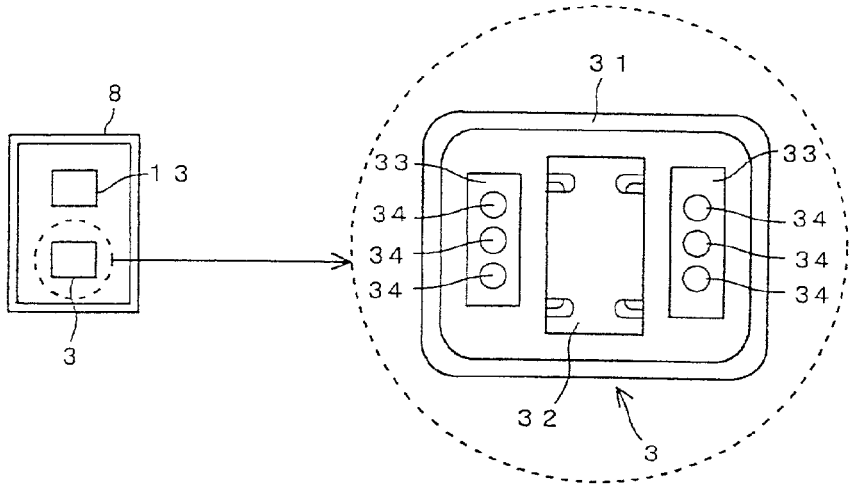
FIG. 17 is a plan view of a main surface of the radio communication unit which faces the helmet.

FIG. 15 is a side cross-sectional view showing a method for attaching the radio communication unit 8 to the helmet 1 according to the embodiment, FIG. 16 is a rear view of the helmet with the radio communication unit 8 not being attached thereto, and FIG. 17 is a plan view of a main surface of the radio communication unit 8 which faces the helmet.

As shown in FIG. 16, an iron plate 10 as a magnetic material plate and a magnet side socket 2 of the magnet connector are fixedly attached to a depressed location in the rear of the helmet at a predetermined vertical interval. It is preferable to apply paint to an exposed portion of the iron plate 10 wherein the paint has a color that is identical to that of the helmet 1.

As shown on the right hand side of FIG. 17 in an enlarged fashion, provided on a connecting surface of the magnet side socket 2 are an S pole iron piece 21S, an N pole iron piece 21N and a plurality of electrodes 23 that are exposed at a bottom portion of a depression 22. The respective electrodes 23 are connected to the microphone 11 and the speaker 12 via lead wires 25, 26.

As shown in FIG. 17, fixedly attached to the main surface of the radio communication unit 8 that faces the helmet at a predetermined vertical interval are a magnet which constitutes a pair of magnetic connectors together with the iron plate 10 and a magnetic material side socket 3 which constitutes a pair of magnetic connectors together with the magnet side socket 2. As shown in FIG. 15, the magnet 13 is constituted by a permanent magnet 132 and a magnet core 131 which covers the sides and back of the permanent magnet, whereby the magnet force of the permanent magnet is entirely applied to the iron plate 10 on the helmet.

As shown on the right hand side of FIG. 17 in an enlarged fashion, provided on a connecting surface of the magnetic material side socket 3 are an annular rib 31 provided along the periphery of the connecting surface in such a manner so as to project therefrom, a magnetic material plate 32 fixedly attached to a bottom portion thereof and an electrode 34 exposed on a land-like portion 33 that rises from the bottom portion.

In the construction as described above, when attaching the radio communication unit 8 to the helmet 1, the magnet side socket 2 of the helmet 1 is fitted in the annular rib 31 on the magnetic material side socket 3, and both the socket and the rib are aligned with each other such that both are drawn to each other by virtue of magnetism to be secured together.

As this occurs, the relative positional relationship between the helmet 1 and the radio communication unit 8, in particular, the angle in a torsional direction is regulated by the annular rib 31 on the magnetic material side socket 3, whereby the magnet side socket 2 and the magnetic material side socket 3 can hold a desired positional relationship therebetween. Furthermore, as a result, the positional relationship between the iron plate 10 on the helmet and the magnet 13 on the radio communication unit 8 is also held in a predetermined relationship, whereby both the iron plate and the magnet can be connected together magnetically.

According to this embodiment, the helmet 1 and the radio communication unit 8 are fixed to each other magnetically, and only the thin, small and flat iron plate 10 and the socket 2 that are made to look highly functional are allowed to be exposed on the surface of the helmet 1 with the radio communication unit 8 not being attached thereto, neither an adhesive tape nor a metal fixture are exposed thereon. Consequently, the good external appearance of the helmet is not deteriorated in any way, and moreover, the handling of the helmet when carrying the same can be facilitated.

In addition, according to the embodiment, the helmet 1 and the radio communication unit 8 are connected to each other magnetically at two locations, whereby the radio communication unit 8 can be simply and rigidly secured to the helmet 1. Furthermore, the electric connection between the helmet and the radio communication machine is maintained through the magnet contact which is highly reliable, whereby a reliable connection is made possible.

Note that while the above embodiment is described such that the magnet 13 acting as the magnetic connector is constituted by the permanent magnet 132 and the magnet core 131, a highly flexible plastic magnet or resin magnet may be employed instead.

Figure 18:
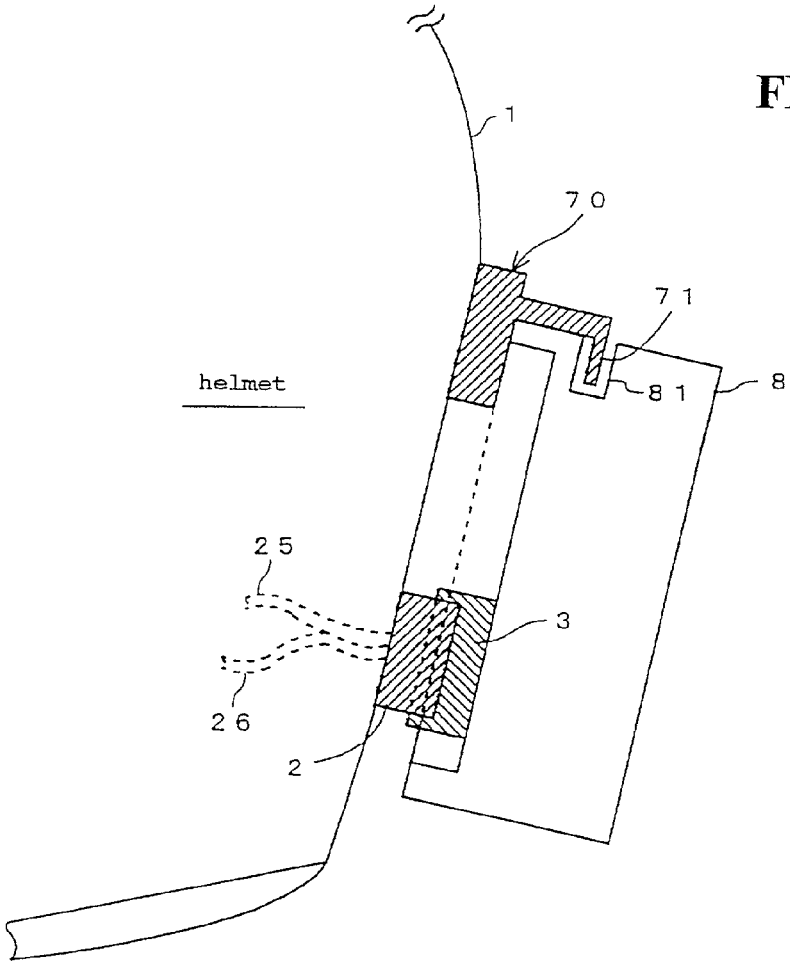
FIG. 18 is a side view showing a second method for attaching the radio communication unit to the helmet.

FIG. 18 is a side cross-sectional view illustrating a method for attaching the radio communication unit 8 to the helmet according to a second embodiment, in which like reference numerals to those described previously denote like or equivalent portions to those described previously.

According to this embodiment, instead of using the magnet connector comprising the iron plate 10 and the magnet 13 a resin damper 70 is fixedly attached to the helmet 1. When wearing the helmet, first a pawl portion 71 of the resin clamper 70 is inserted into an engagement hole 81 formed in a side of the radio communication unit 8, and thereafter the magnet side socket 2 and the magnetic material side socket 3 are connected together.

According to the embodiment, with the radio communication unit 8 not being attached to the helmet 1, since the resin clamper 70 is exposed on the surface thereof, when carrying the helmet 1, slightly more care is needed when compared to the first embodiment. However, since a connector such as an adhesive tape which would deteriorate the good external appearance of the helmet is not allowed to be exposed on the surface, the good external appearance of the helmet is not deteriorated even with the radio communication unit is not attached thereto. Furthermore, since the resin clamper 70 is easy to paint, when the clamper is painted with the same color as that of the helmet 1, the existence of the clamper is made less conspicuous.

According to the present invention, when an excessive input signal attributed to sneezing or coughing is detected, the gain of the amplifier for amplifying the voice signal is reduced for the predetermined period of time in which the sneezing or the like is predicted to be deadened, whereby an excessive input signal is not generated substantially, thereby making it possible to realize with a simple construction the speech communication apparatus which does not transmit to the speech communication partners an uncomfortable noise such as a sneezing, a coughing or a throat-clearing noise.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A speech communication apparatus including a speech communication microphone, a speaker and a communication unit for amplifying an output signal from said speech communication microphone, said speech communication microphone and said speaker being fixedly disposed in the vicinity of a mouth and an ear of an individual, respectively, said communication unit comprising:

amplifying means for amplifying an input signal and outputting said input signal so amplified; and control means for controlling the gain of said amplifying means in response to an excessive input signal, said control means including:

a VOX detection circuit, a sneezing detection circuit, and an OR circuit, the OR circuit for outputting a theoretical sum of an output signal from the VOX detection circuit and an output signal from the sneezing detection circuit for controlling the gain of said amplifying means such that a reproduced sound of said excessive input signal is reduced to a predetermined level only for a predetermined period of time when said excessive input signal is detected.

2. The speech communication apparatus according to claim 1, wherein said control means controls the gain of said amplifying means by detecting an input signal corresponding to sneeze or cough.

3. The speech communication apparatus according to claim 2, and further including operation means for varying said predetermined period of time.

4. The speech communication apparatus according to claim 3, wherein said predetermined period of time is set at a range from 0.7 to 5 seconds both inclusive.

5. The speech communication apparatus according to claim 2, wherein said predetermined period of time is set at a range from 0.7 to 5 seconds both inclusive.

6. The speech communication apparatus according to claim 1, and further including operation means for varying said predetermined period of time.

7. The speech communication apparatus according to claim 6, wherein said predetermined period of time is set at a range from 0.7 to 5 seconds both inclusive.

8. The speech communication apparatus according to claim 1, wherein said predetermined period of time is set at a range from 0.7 to 5 seconds both inclusive.

9. The speech communication apparatus according to claim 1, and further including operation means for varying said predetermined level of said excessive input signal.

10. A speech communication apparatus including a speech communication microphone, a speaker and a communication unit for amplifying an output signal from said speech communication microphone, said speech communication microphone and said speaker are fixedly disposed in the vicinity of a mouth and an ear of an individual, respectively, communication unit comprising:

amplifying means for amplifying an input signal and outputting said input signal so amplified; and control means for controlling the gain of said amplifying means in response to an input signal which exceeds a first predetermined level, said control means including:

a VOX detection circuit, a sneezing detection circuit, and an OR circuit, the OR circuit for outputting a theoretical sum of an output signal from the VOX detection circuit and an output signal from the sneezing detection circuit for controlling the gain of said amplifying means such that a reproduced sound of said input signal which exceeds the first predetermined level is reduced to a second predetermined level for a predetermined period of time when said input signal exceeding a first predetermined level is detected.

11. The speech communication apparatus according to claim 10, wherein said control means controls the gain of said amplifying means by detecting an input signal corresponding to sneeze or cough.

12. The speech communication apparatus according to claim 11, and further including operation means for varying said predetermined period of time.

13. The speech communication apparatus according to claim 12, wherein said predetermined period of time is set at a range from 0.7 to 5 seconds both inclusive.

14. The speech communication apparatus according to claim 11, wherein said predetermined period of time is set at a range from 0.7 to 5 seconds both inclusive.

15. The speech communication apparatus according to claim 10, and further including operation means for varying said predetermined period of time.

16. The speech communication apparatus according to claim 15, wherein said predetermined period of time is set at a range from 0.7 to 5 seconds both inclusive.

17. The speech communication apparatus according to claim 10, wherein said predetermined period of time is set at a range from 0.7 to 5 seconds both inclusive.

18. The speech communication apparatus according to claim 10, and further including operation means for varying said first predetermined level of said excessive input signal.

19. A speech communication apparatus including a speech communication microphone, a speaker and a communication unit for amplifying an output signal from said speech communication microphone, said speech communication microphone and said speaker are fixedly disposed in the vicinity of a mouth and an ear of an individual, respectively, said communication unit comprising:

an amplifier for amplifying an input signal and outputting said input signal so amplified; and a controller to control the gain of said amplifier in response to an excessive input signal, wherein said controller controls the gain of said amplifier such that a reproduced sound of said excessive input signal is reduced to a predetermined level only for a predetermined period of time when said excessive input signal is detected, wherein said predetermined period of time is set at a range from 0.7 to 5 seconds both inclusive.

20. The speech communication apparatus according to claim 19, wherein said control means controls the gain of said amplifying means by detecting an input signal corresponding to sneeze or cough.

21. The speech communication apparatus according to claim 20, and further including operation means for varying said predetermined period of time.

22. The speech communication apparatus according to claim 19, and further including operation means for varying said predetermined period of time.

23. The speech communication apparatus according to claim 19, and further including operation means for varying said predetermined level of said excessive input signal.

24. A speech communication apparatus including a speech communication microphone, a speaker and a communication unit for amplifying an output signal from said speech communication microphone, said speech communication microphone and said speaker being fixedly disposed in the vicinity of a mouth and an ear of an individual, respectively, said communication unit comprising:

amplifying means for amplifying an input signal and outputting said input signal so amplified; and control means for controlling the gain of said amplifying means in response to an input signal, wherein said control means controls said amplifying means such that said amplifying means becomes mute for a predetermined time when said input signal exceeds a predetermined level.

25. The speech communications apparatus according to claim 24, wherein said speech communication microphone and said speaker are fitted in a helmet.

26. A speech communication apparatus including a speech communication microphone, a speaker and a communication unit for amplifying an output signal from said speech communication microphone, said speech communication microphone and said speaker being fixedly disposed in the vicinity of a mouth and an ear of an individual, respectively, said communication unit comprising:

amplifying means for amplifying an input signal and outputting said input signal so amplified; and control means for controlling the gain of said amplifying means in response to an input signal, wherein said control means controls said amplifying means such that said amplifying means becomes mute for a predetermined time when said input signal stays below a predetermined level.

27. The speech communications apparatus according to claim 26, wherein said speech communication microphone and said speaker are fitted in a helmet.

* * * * *